US006375001B1

(12) United States Patent
Beach

(10) Patent No.: US 6,375,001 B1
(45) **Date of Patent: *Apr. 23, 2002**

(54) LIQUID STORING POUCH AND EXTRACTOR

(76) Inventor: Harland J. Beach, 710 Alicia Ct., Rapid City, SD (US) 57701

( * ) Notice: Subject to any disclaimer, the term of this patent is extended or adjusted under 35 U.S.C. 154(b) by 0 days.

This patent is subject to a terminal disclaimer.

(21) Appl. No.: 09/026,351

(22) Filed: Feb. 19, 1998

Related U.S. Application Data

(60) Provisional application No. 60/038,297, filed on Feb. 21, 1997.

(51) Int. Cl.[7] ..... B65D 77/28

(52) U.S. Cl. ..... 206/217; 229/103.1; 383/202; 383/906; 426/85

(58) Field of Search ..... 426/85; 383/202, 383/906; 229/103.1; 206/217

(56) References Cited

U.S. PATENT DOCUMENTS

| | | | | |
|---|---|---|---|---|
| 2,328,372 A | | 8/1943 | Wollenweber | |
| 2,752,083 A | | 6/1956 | Ullman | |
| 2,849,321 A | | 8/1958 | Lhermitte et al. | |
| 2,992,118 A | | 7/1961 | Daline | |
| 3,074,612 A | | 1/1963 | Schneider | |
| 3,144,976 A | | 8/1964 | Freshour | |
| 3,545,604 A | | 12/1970 | Gunther | |
| 3,730,336 A | | 5/1973 | Feldman | |
| 3,730,337 A | | 5/1973 | White | |
| 3,791,570 A | | 2/1974 | Hopkins | |
| 3,799,914 A | | 3/1974 | Schmit et al. | |
| 3,802,324 A | | 4/1974 | Izumi et al. | 93/35 |
| 3,874,554 A | | 4/1975 | Chang | |
| 4,226,356 A | | 10/1980 | Lemelson | |
| 4,252,256 A | | 2/1981 | Walsh | |
| 4,411,359 A | | 10/1983 | Franco | |
| 4,553,693 A | | 11/1985 | Terajima et al. | 229/7 |
| 4,614,074 A | | 9/1986 | Evers | 53/128 |
| 4,631,905 A | | 12/1986 | Maloney | 53/554 |
| 4,660,737 A | | 4/1987 | Green et al. | |
| 4,718,778 A | | 1/1988 | Ichikawa | |
| 4,736,572 A | | 4/1988 | Fang et al. | 53/512 |
| 4,783,176 A | | 11/1988 | Ichikawa | |
| 4,792,083 A | | 12/1988 | Yassur | |
| 4,795,271 A | | 1/1989 | Lane, Jr. et al. | 383/104 |
| 4,806,021 A | | 2/1989 | Koudstaal et al. | |
| 4,858,766 A | | 8/1989 | Tsai | |
| 4,887,912 A | | 12/1989 | Stumpf | 383/66 |
| 4,928,852 A | | 5/1990 | Guiffray | 222/107 |
| 5,038,548 A | | 8/1991 | Sieg | |
| 5,052,614 A | | 10/1991 | Xuan | |
| 5,116,105 A | | 5/1992 | Hong | 229/103.1 |
| 5,201,460 A | | 4/1993 | Caines | |
| 5,231,817 A | | 8/1993 | Sadler | 53/451 |
| 5,255,497 A | | 10/1993 | Zoromski et al. | 53/551 |
| 5,261,532 A | | 11/1993 | Fauci | |
| 5,303,838 A | | 4/1994 | Luch et al. | 220/270 |
| 5,334,400 A | | 8/1994 | Purdham | |
| 5,425,583 A | | 6/1995 | Wild | 383/202 |
| 5,564,621 A | | 10/1996 | Writt | |
| 5,782,344 A | * | 7/1998 | Edwards et al. | 229/103.1 |
| 5,833,368 A | * | 11/1998 | Kaufman | 383/202 |
| 5,884,758 A | * | 3/1999 | Sigouin et al. | 383/200 |

FOREIGN PATENT DOCUMENTS

| | | | |
|---|---|---|---|
| CA | 639812 | 4/1962 | |
| FR | 789368 | 1/1958 | |
| FR | 1253311 | 11/1971 | B65B/9/08 |

* cited by examiner

*Primary Examiner*—Stephen P. Garbe
(74) *Attorney, Agent, or Firm*—Curtis Harr

(57) ABSTRACT

A pouch of flexible plastic sheet material has an internal chamber holding a liquid. The plastic sheet material above the liquid is in a collapsed position to allow expansion and movement of the liquid in the chamber and permit an elongated tubular extractor located within the chamber to be forced through a portion of the plastic sheet material so that the liquid within the chamber can be withdrawn through the tubular extractor.

13 Claims, 5 Drawing Sheets

LIQUID STORING POUCH AND EXTRACTOR

This application claims the benefit of U.S. Provisional Application No. 60/038,297 filed Feb. 21, 1997.

FIELD OF THE INVENTION

The invention is in the technical art of disposable containers for storing liquids, such as potable water, and extractors stored in the containers for removing liquid from the containers.

BACKGROUND OF THE INVENTION

Water historically was stored and transported in bags made from animal skins and earthen jars. Leather flasks and glass and metal bottles were later used as portable containers for water and other liquids. Plastic bottles, metal cans and paper cartons are presently used to store milk, carbonated beverages and fruit juices. Glasses and cups are normally used to drink these beverages. Tubular plastic straws are also used to draw liquids from cups and containers. The straws are packaged in paper envelopes and boxes separate from the cups and containers. A separate inventory of straws is required which increase costs and reduce consumer convenience. Soy sauce, mustard and sweet and sour sauce are packaged in plastic envelopes. One edge of the envelope must be ripped open so that the contents can be squeezed out onto food.

Liquids have been packaged in closed flexible plastic bags. Straws are packaged with the liquid in the bags. The straws are forced through seams in the bags so that the external ends of the straws are used to suck the liquids from the bags. Examples of plastic bags accommodating liquids and straws are disclosed by W. S. Schneider in U.S. Pat. No. 3,074,612 and A. Feldman in U.S. Pat. No. 3,730,336. Straws mounted on containers storing liquids are disclosed by W. Koudstall, A. Thomas, and J. L. Lewis in U.S. Pat. No. 4,806,021 and J.Xuan in U.S. Pat. No. 5,052,614. The straws must be forced into the container so that the straws can be used to suck liquids from the containers.

SUMMARY OF THE INVENTION

The invention relates to a liquid storing pouch and an extractor for removing liquid from the pouch. The pouch and extractor are made of low cost, disposable and recyclable materials, such as plastic films. The pouch has an outer flexible wall enclosing a chamber for storing the liquid. The upper portion of the wall is collapsed to allow movement of the liquid in the chamber and the easy penitration of pouch by the extractor without increasing the pressure of the liquid in the pouch. The extractor is an elongated tube or stiff straw stored within the chamber storing the liquid. The liquid is confined to the chamber until it is removed from the chamber with the use of the extractor. The pouch prevents contamination of the liquid and extractor and permits the transport of liquid without the use of expensive bottles and cans. In use an end of the extractor is moved through a portion of the wall of the pouch so that the tube can be used to draw liquid from the chamber.

The invention also relates to methods of making and partly filling the pouch with a liquid with an extractor located within the pouch. A pouch having one open end is positioned to receive an elongated linear tubular extractor. The extractor is inserted into the chamber of the pouch through the open end thereof The extractor may be subjected to ultra violet light to kill foreign agents before the extractor is inserted into the chamber of the pouch. A metered amount of liquid, such as water, fruit juices, wine, schnapps, tea, and milk, is dispensed into the chamber accommodating the extractor. The extractor in an alternative process can be inserted into the chamber at the same time that the liquid is dispensed into the chamber. A spray of liquid is dispensed into the chamber to reduce the amount of foam on top of liquids that generate foam in the chamber to facilitate the dispensing of liquid into the chamber. The level of the liquid in the chamber is below the top of the pouch. The side walls of the pouch are forced together with pressure plates to reduce the amount of air in the chamber and establish a partial vacuum in the chamber. Atmospheric air pressure collapse the side walls of the pouch together and allow the pouch to be squeezed without substantially increasing the pressure of the liquid in the pouch. The open end of the pouch is then sealed with one or more heat sealing bars. The upper portions of the side walls of the pouch are held together with the pressure plates during the sealing procedure to prevent air from reentering the upper chamber above the liquid in the chamber.

DESCRIPTION OF THE PREFERRED EMBODIMENTS

Figure 1:
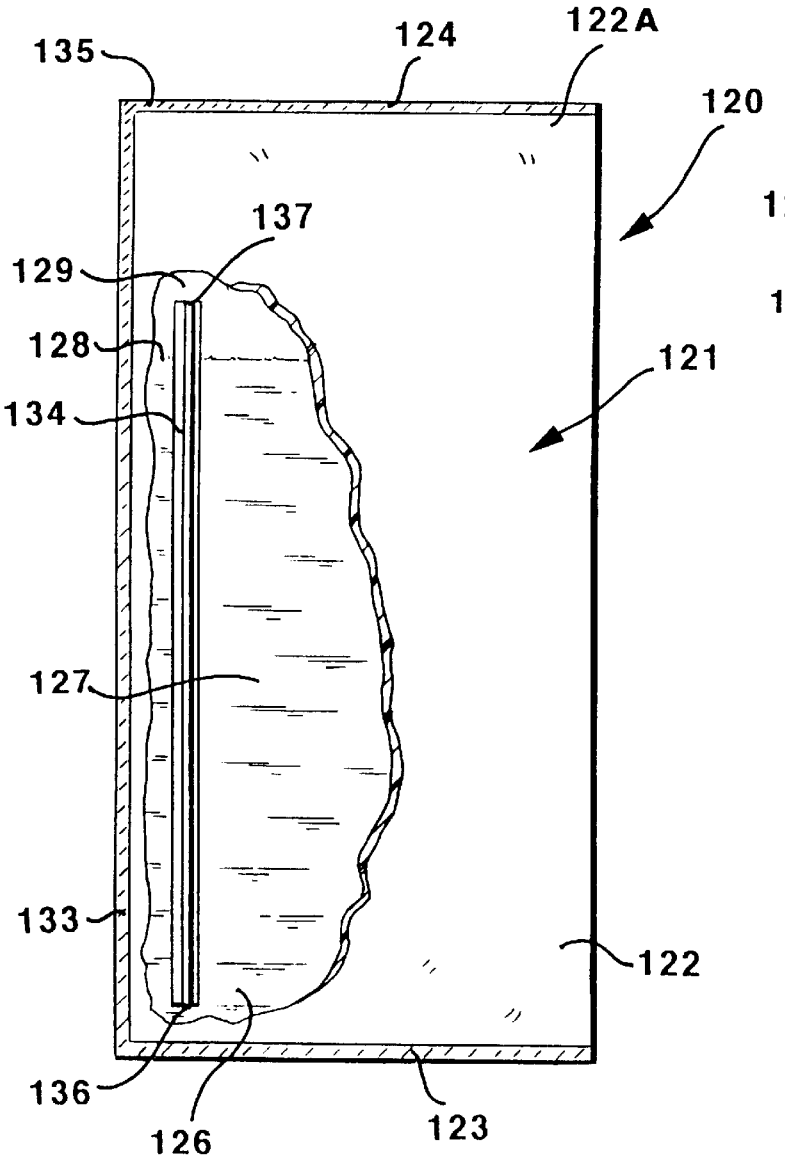
FIG. 1 is a side elevational view partly sectioned of the COMBINED LIQUID STORING POUCH AND EXTRACTOR for removing liquid from the pouch.
Figure 2:
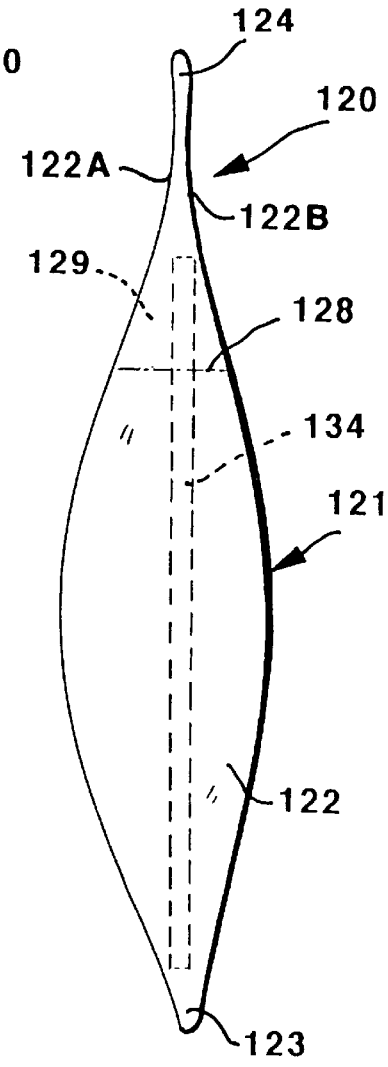
FIG. 2 is a side elevational view thereof.

Referring to FIGS. 1 and 2, a combined liquid storing pouch and extractor 120 holds a quantity of liquid 127, such as potable water. Other liquids and semi-liquids, such as fruit juices, coffee, tea, milk, schnapps, wine and non-carbonated beverages, can be stored in the combined liquid storing pouch and extractor 120. The liquid is contained within a pouch 121 having a size to store between 0.9 to 2 liters of liquid. The size of the pouch can vary to store different amounts of liquid. Pouch 121 has an enclosed chamber 126 partly filled with a liquid 127. Chamber 126 is between 60% and 90% filled with liquid to allow for movement and circulation of liquid 127 within chamber 126 and facilitate gripping and forcing an extractor 134 out of pouch 121 without increasing the pressure of the liquid and discharging liquid out of the pouch. Small size pouches can be 60 to 70 percent filled with liquids to provide space for the liquid and allow gripping of extractor 134 and forcing the end of extractor 134 out of pouch 121. Large size pouches can be 80 to 90 percent filled with liquids as there are sufficient empty spaces within the pouches to allow the extractor stored within the pouch to be manually moved out of the pouch. The upper or top surface 128 of liquid 127 is below the top of pouch 121 to provide an upper chamber or empty space 129 above liquid 127. Chamber 126 is about three times the volume of chamber 129. About 75 percent of the total volume of pouch 121 is filled with liquid. Other amounts of liquid can be placed in pouch 121. Wall 122 has upper first and second portions 122A and 122B in collapsed positions which reduces the volume of air in upper chamber 129. The air in space 129 has been partly evacuated or removed to permit movement of liquid 127 without placing extreme forces on the pouch side wall 122 and allow a person to force an extractor 134 through a portion of the wall of pouch 121. Pouch 121 is a tubular, flexible, and liquid impervious wall 122 having a transverse bottom closure 123 and a transverse top closure 124. Wall 122 is a liquid impervious flexible plastic sheet, such as polyethylene or polyproplyene plastic film. Other types of plastic and materials can be used for at the wall of pouch 121. Closures 123 and 124 are transverse heat seals joining adjacent transverse end portions of wall 122 together. A linear heat seal 133 closes a side of pouch 121. Pouch 121 can be made from sheets of plastic film by folding the sheet and sealing adjacent longitudinal edges. Transverse seals are used to close opposite ends of the folded sheet. The outside surfaces of pouch 121 have substantial areas to accommodate printed information and designs. The same size pouch can be used for different quantities of liquid with the same printed information. Information as to the amount of liquid stored in the pouch can be included on labels attached to the pouch or included with the printed information on the pouch.

An extractor 134, located in chamber 126, is an elongated rigid tubular member having an open lower end 136 and an open upper end 137. Ends 136 and 137 have transverse circular edges located in planes normal or 90 degrees to the longitudinal axis of the tube. Extractor 134 can be a tubular linear plastic straw.

In use, extractor 134 is placed above the liquid in chamber 129 and then pushed through a wall 122 of pouch 121 adjacent wall portion 135. Location of extractor 134 in chamber 129 above the liquid allows extractor 134 to be pushed through wall 122 without increasing pressure on the liquid and causing the liquid to squirt out the bag. The end 136 extractor 134 is gripped with the thumb and finger of one hand. The other hand holds bag member 122 and guides the end 137 of extractor 134 toward wall portion 135. The person's hands are moved toward each other to force the end 137 of the extractor 134 through wall portion 135. The plastic sheet material of wall portion 135 surrounding extractor 134 is an annular sleeve located in tight engagement with extractor 134 to prevent leakage of liquid from chamber 126. Extractor 134 is used as a straw by a person to draw liquid 127 from chamber 125. The walls of pouch 121 can be squeezed to apply pressure to liquid 127 thereby forcing liquid 127 to flow through extractor 34 to a location outside of pouch 121.

Figure 3:
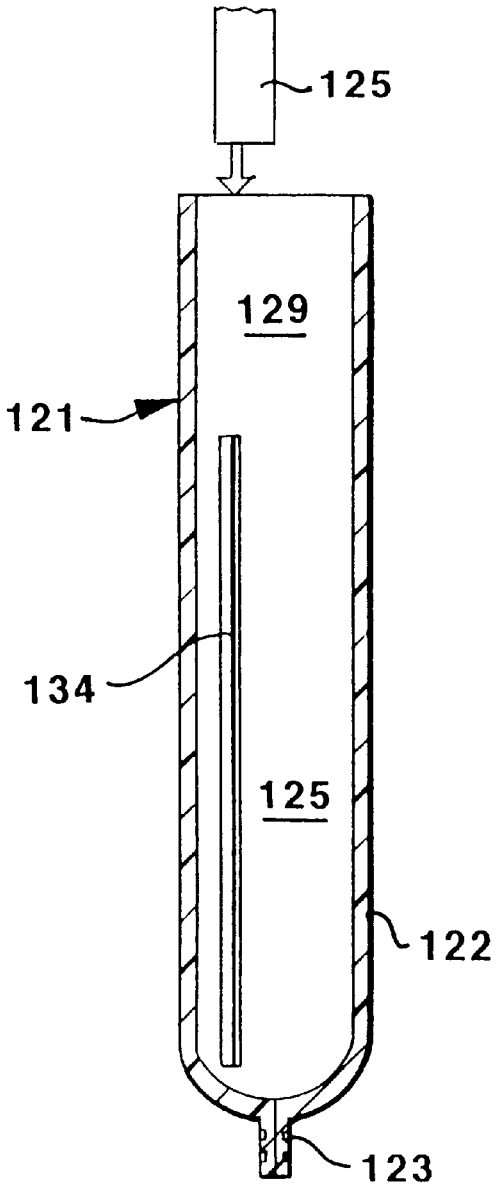
FIG. 3 is an upright sectional view of the open pouch containing a tubular extractor prior to dispensing liquid into the pouch.

A process for inserting the extractor, partly filling the pouch, evacuating or forcing air from the pouch, and sealing the open end of the pouch is illustrated in FIGS. 3 to 8. As shown in FIG. 3, extractor 134 is placed in the empty chamber 126 of pouch 121. The bottom of wall 122 is closed with seal 123. The top of wall 122 is open to allow extractor 134 to be dropped vertically down into chamber 126 from a dispenser 125. The extractor dispenser 125 may be provided with an ultra violet light unit operable to assassinate and destroy foreign agents that may have contaminated the extractor.

Figure 4:
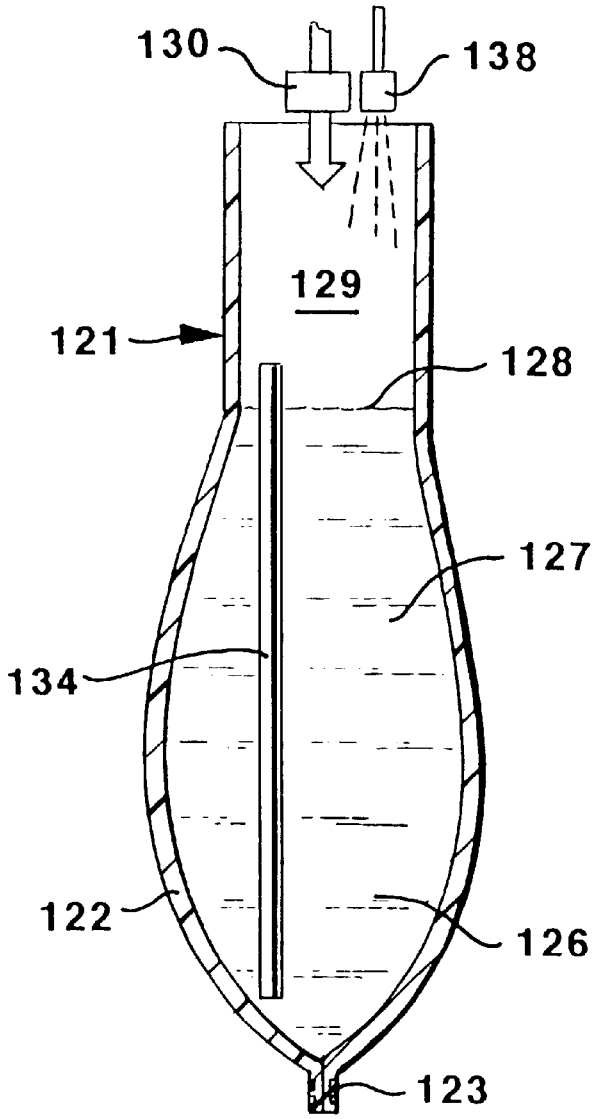
FIG. 4 is an upright section view of the open pouch with liquid being dispensed into the pouch.

Pouch 121 is maintained in an upright position and partly filled with liquid 127 as shown in FIG. 4. Extractor 134 can be inserted into chamber 126 during the dispensing of liquid into chamber 126. A liquid dispenser (not shown) having dispensing head 130 is used to place a metered amount of liquid in chamber 126. An example of a liquid dispenser is disclosed by J. E. Wollenweber in U.S. Pat. No. 2,318,372. Some liquids, such as grape juice and milk, general foams on top of the liquids which inhibit filling of liquids into chamber 126. A foam dissapator having a nozzle 138 directs a spray of liquid into chambers 126 and 129. The liquid particles of the spray break down the foam thereby reducing the time to fill the chamber 126 with liquid. The spray of liquid can be the same liquid that is being dispensed into chamber 126. An example of a liquid defoaming method and apparatus is disclosed by W. F. Sieg in U.S. Pat. No. 5,038,548, which is incorporated herein by reference. The level 128 of liquid 127 is below the top of pouch 121 providing an upper chamber 129 containing air. Sixty to Ninety percent of the entire chamber of pouch 121 is filled with liquid 127. The amount of liquid compared to the size of chamber 126 can vary. The percentage of liquid in chamber 126 increases with the volume of chamber 126.

Figure 5:
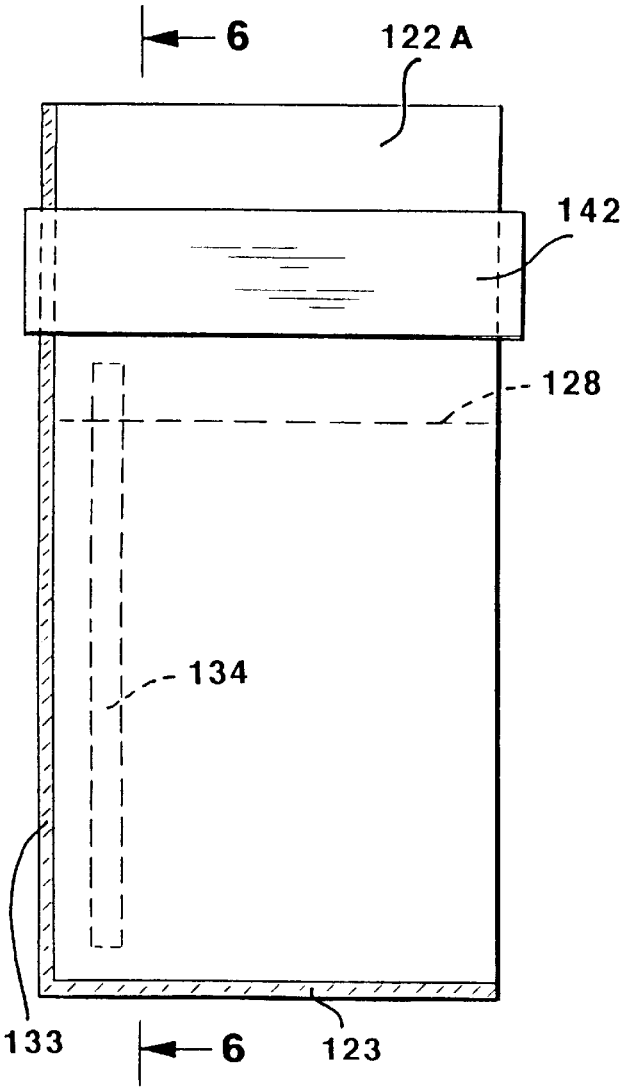
FIG. 5 is a side elevational view of the pouch containing liquid and an extractor associated with pressure plates for removing air from the pouch above the liquid in the pouch.
Figure 6:
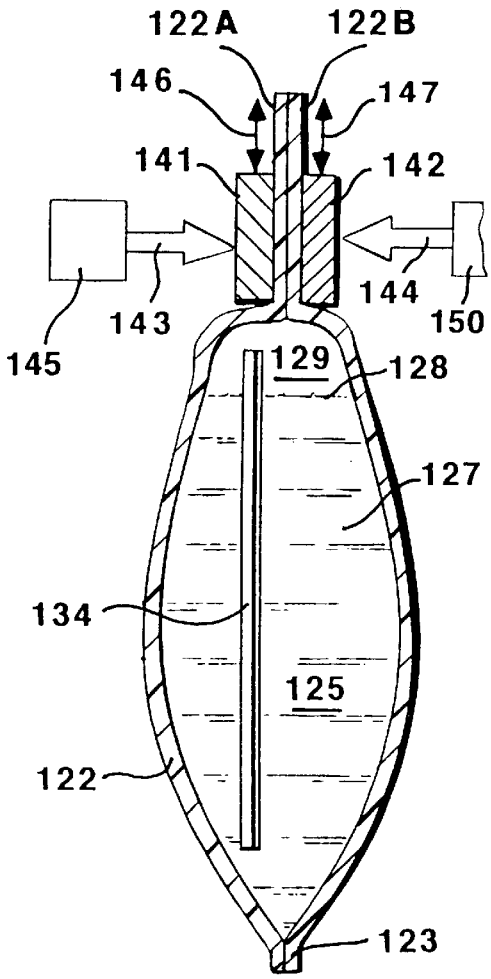
FIG. 6 is a sectional view taken along line 6—6 of FIG. 5.

The amount of air in chamber 129 is substantially reduced by forcing the side walls 122A and 122B together to reduce the size of chamber 129. As shown in FIGS. 5 and 6, the air is forced out of chamber 129 with blocks or pressure plates 141 and 142 located adjacent opposite sides of side walls of pouch 121. Pressure plates 141 and 142 are moved toward each other, as shown by arrows 143 and 144, with actuators 145 and 150 to force the side walls of pouch 121 to collapsed positions. The volume of chamber 129 is reduced. Pressure plates 141 and 142 are flat plates with flat surfaces that squeeze rectangular transverse surfaces of the upper wall of pouch 121 together. The width of pressure plates 141 and 142 can vary to accommodate different size pouches and volumes of liquid in the pouches. As shown in FIG. 5, pressure plates 141 and 142 extend transversely across the upper end of pouch 121 to close an entire transverse surface of the upper end of the pouch 121. Actuators 145 and 150 operatively connected to pressure plates 141 and 142 can be mechanical devices or hydraulic or air cylinders operable move pressure plates 141 and 142 toward and away from each other. Pressure plates 141 and 142 are vertically adjustable, as shown by arrows 146 and 147, to vary the volume of upper chamber 129 and allow changes in the volume of liquid stored in chamber 125. Rollers adjacent opposite sides of the side walls of pouch can be used to force air out of chamber 129.

Figure 7:
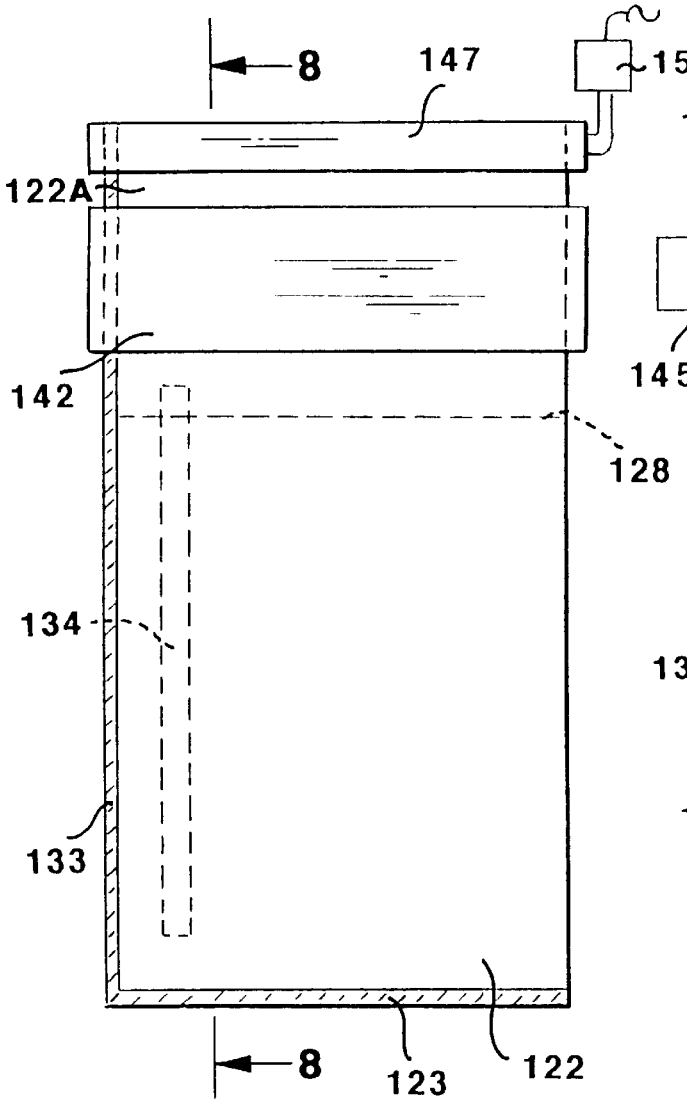
FIG. 7 is a side elevational view of the pouch containing liquid and an extractor and heat sealing bar for sealing the open end of the pouch.
Figure 8:
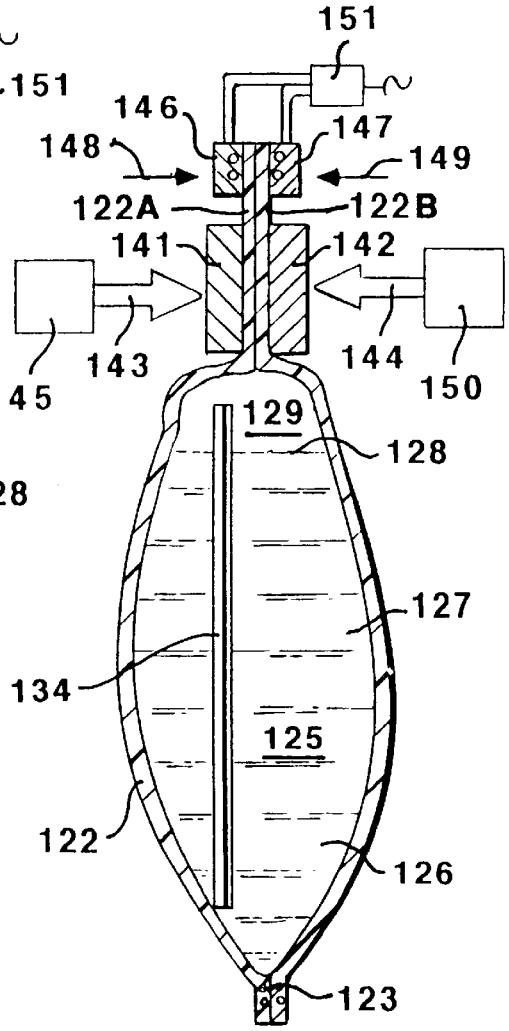
FIG. 8 is a sectional view taken along line 8—8 of FIG. 7.

As shown in FIGS. 7 and 8, the portions of the side walls 122A and 122B above pressure plates 141 and 142 are heat sealed together with heater bars 146 and 147. The heater bars 146 and 147 are clamped together as shown by arrows 148 and 149 to seal the upper end of bag member 122. Bars 146 and 147 form a transverse heat seal 124, as shown in FIG. 8, across the top of pouch 121. A control 151 coupling heater bars 146 and 147 to an electric power source regulates the heat sealing of opposite sides of the plastic of pouch 121. Both sides of the upper end of pouch 121 are heat sealed to ensure the integrity of seal 124. Some types of plastic only require a heat seal bar on one side of the upper end of the pouch. Pressure plates 141 and 142 are maintained tight against the side walls 122A and 122B of pouch 121 during the sealing procedure to prevent air from entering chamber 129. When seal 124 is complete the pouch is removed from heater bars 146 and 147 and pressure plates 141 and 142. Pressure plates 141 and 142 and heater bars 146 and 147 are moved outwardly away from the upper end of pouch 121 to allow pouch filled with liquid and an extractor to be packaged.

Figure 9:
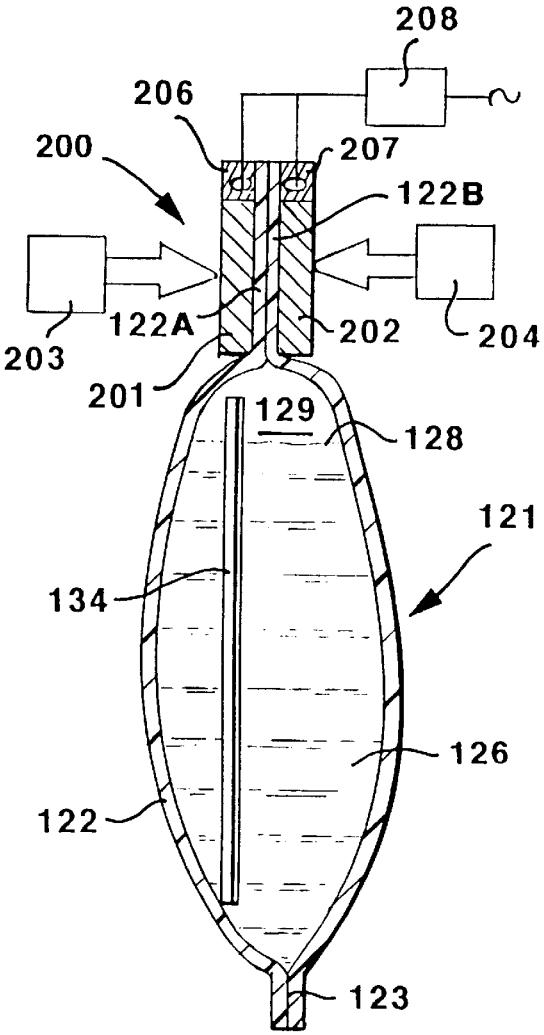
FIG. 9 is a sectional view similar to FIG. 8 wherein the upper end of the pouch is closed and sealed with combined pressure plates and heat sealing bars.

FIG. 9 shows the upper end of pouch 121 being closed with combined pressure plates and heater bar assembly 200 operable to force air out of the chamber 129 of pouch 121 and heat seal the top edge of pouch 121. Assembly 200 has a pair of pressure plates 201 and 202 coupled to activators 203 and 204. Activators 203 and 204, such as mechanical, hydraulic or air cylinders, move pressure plates 201 and 202 toward each other to reduce the volume of air in chamber 129 of pouch 121. Pressure plates 201 and 202 have flat rectangular surfaces that hold corresponding surfaces of pouch 121 together. Heater bars 206 and 207 are attached to pressure plates 201 and 202 and provide an extension of the pressure plates. Alternatively, the heating elements that make the heat seal across the top of pouch 121 can be mounted directly on the upper portions of the pressure plates. A control 208 coupling the heating elements of the heater bars 206 and 207 to an electric power source regulates the heat sealing of opposite sides of the plastic of pouch 121. Pressure plates 201 and 202 remain in pressing engagement with the pouch 121 during the heat sealing operation of heater bars 206 and 207. When the heat sealing is complete, pressure plates 201 and 202 and heater bars 206 and 207 are moved with actuators 203 and 204 away from pouch 121 to allow pouch 121 containing liquid and an extractor to be packaged.

Figure 10:
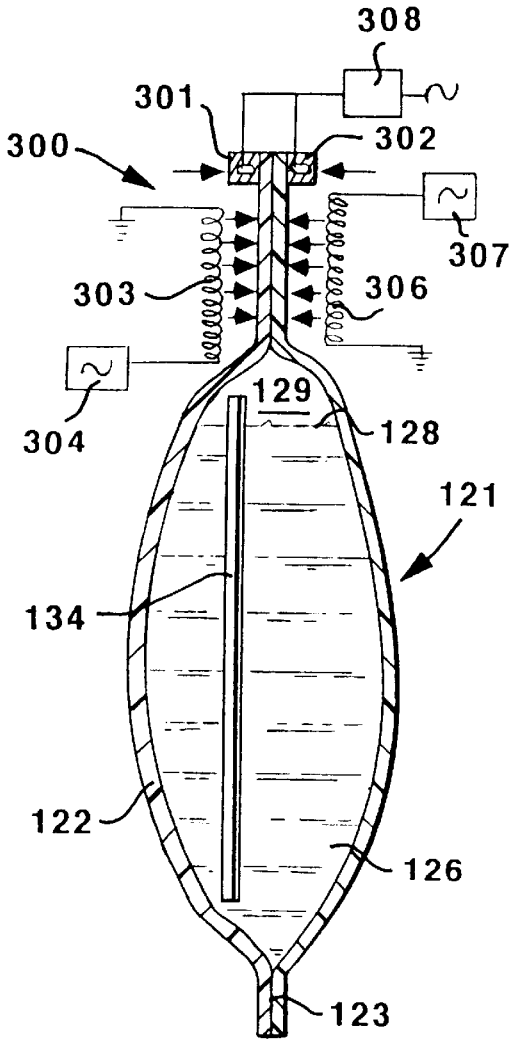
FIG. 10 is a sectional view similar to FIG. 8 wherein the upper end of the pouch is closed with electromagnetic forces and sealed with heat sealing bars.

Referring to FIG. 10, pouch 121 is closed with an electromagnetic assembly 300 and sealed with heater bars 301 and 302. Assembly 300 has a pair of coils 303 and 306 located adjacent opposite sides of the upper portion of pouch 121. The coils are electrodes connected to power source controls 304 and 307 operable to control the flow of electric power to coils 303 and 306. The energized coils 303 and 306 generate electric fields and static electrical forces that move upper portions of pouch 121 together to force air from chamber 129 and hold these portions together. Heater bars 301 and 302 coupled to electric power source controls 308 heat seal the upper edge of pouch 121 during the time that the electromagnetic assembly 300 holds the upper portions of pouch 121 together.

While there have been shown and described an embodiment of the combined pouch and extractor, and methods of making the pouch with a liquid and extractor, it is understood that changes in the structures, arrangement of structures and parts, and structures for predicating the methods of making the pouch with an extractor may be made by those skilled in the art without departing from the invention. The invention is defined in the following claims.

What is claimed is:

1. A liquid storing pouch and an extractor for removing liquid from the pouch comprising: a pouch having a wall providing a sealed internal chamber, a liquid contained within the chamber occupying 90% or less of the volume of the chamber defining a volume of the chamber that does not contain liquid, said wall including first and second flexible side walls surrounding the chamber, said volume of the chamber that does not contain liquid having a portion of air evacuated therefrom in sufficient quantity to permit the liquid to be displaced within the chamber whereby portions of the side walls are located in adjacent collapsed positions within the volume of the chamber that does not contain liquid, means securing adjacent portions of the first and second side walls together to enclose the liquid within the chamber, and a rigid extractor located within the chamber for removing liquid from the chamber, said extractor having a length shorter than said side walls and being free floating in the liquid across said side walls whereby when the side walls are collapsed towards one another the free floating extractor can be grasped so that a portion thereof can be forced through a portion of said wall whereby the liquid in said chamber can be removed with the extractor to a location externally of the pouch.

2. The pouch and extractor of claim 1 wherein: 60 to 90 percent of the volume of the internal chamber accommodates said liquid.

3. The pouch and extractor of claim 1 wherein: the extractor is an elongated rigid tubular member having open opposite ends and a passage extended between said ends for carrying liquid through the tubular member.

4. The pouch and extractor of claim 1 wherein: the wall comprises flexible plastic sheets having opposite ends and at least one side heat sealed together to confine the liquid and extractor to the internal chamber.

5. The pouch and extractor of claim 4 wherein: the extractor is a rigid linear straw.

6. The pouch and extractor of claim 1 wherein: the portion of the wall that surrounds the extractor after the extractor has been moved through the wall forms a seal between the wall and extractor.

7. A liquid storing pouch and extractor for removing liquid from the pouch comprising: flexible plastic walls providing an internal chamber, a liquid filing from 60 to 90 percent of the volume of the chamber, a remaining volume of the chamber having a portion of air evacuated therefrom in sufficient quantity to permit the liquid to be displaced within the chamber whereby portions of said walls above said liquid are in adjacent collapsed positions, a seal securing adjacent edge portions of the walls together to enclose the liquid within the chamber, and an elongated rigid tubular means located within the chamber for removing liquid from the chamber, said tubular means having a length shorter than said walls and being free floating in the liquid in the chamber and displaced in the liquid across said walls whereby when the walls are in the collapsed position the free floating tubular means can be grasped so that a portion thereof can be forced through a portion of said wall whereby the liquid in said chamber can be removed with the tubular means to a location externally of the pouch.

8. The pouch and extractor of claim 7 wherein: the seal comprises at least one heat seal securing adjacent edge portions of the ends and one side of the walls together to enclose the liquid within the chamber.

9. The pouch and extractor of claim 7 further comprising: a seal between said wall and said tubular means on the portions of the wall that surrounds the tubular means, after the tubular means has been moved through the wall.

10. A combined liquid storing pouch and an extractor for removing liquid from the pouch comprising: a pouch for holding a liquid, a tubular extractor for removing liquid from the pouch, said pouch having flexible walls providing an internal chamber having a lower chamber for holding the liquid, and an upper chamber containing a limited amount of gas, a liquid in said lower chamber, said lower chamber having a volume of from 60 to 90 percent of the total volume of the inner chamber, the remaining volume of the inner chamber having a portion of the gas evacuated therefrom in sufficient quantity to permit the liquid to be displaced within the chamber whereby portions of the walls surrounding the upper chamber are in adjacent collapsed positions above the level of the liquid in the chamber said extractor having a length shorter than said wall and being free floating in the liquid in the chamber and displaced in the liquid across said wall whereby when the walls are in the collapsed positions the free floating extractor can be grasped so that a portion of the extractor can be moved from said chamber through a portion of said walls whereby the liquid in said chamber can be removed through said extractor to a location externally of the pouch.

11. The pouch and extractor of claim 10 wherein: the walls are flexible plastic sheets having ends joined together.

12. The pouch and extractor of claim 10 wherein: the extractor is an elongated rigid tube having open opposite ends and a passage extended between said ends for carrying liquid through the tube.

13. The pouch and extractor of claim 10 further comprising: a seal between the portion of the wall that surrounds the extractor after the extractor has been moved through the wall and said extractor.

* * * * *